US006880912B2

(12) United States Patent
Klausbruckner et al.

(10) Patent No.: US 6,880,912 B2
(45) **Date of Patent: *Apr. 19, 2005**

(54) PRINTHEAD SERVICE STATION

(75) Inventors: Michael J Klausbruckner, San Diego, CA (US); Robert W Beauchamp, Carlsbad, CA (US); Victor Graham, San Marcos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 47 days.

This patent is subject to a terminal disclaimer.

(21) Appl. No.: 10/463,373

(22) Filed: Jun. 17, 2003

(65) Prior Publication Data

US 2003/0227503 A1 Dec. 11, 2003

Related U.S. Application Data

(63) Continuation of application No. 10/046,456, filed on Oct. 25, 2001, now Pat. No. 6,663,215.

(51) Int. Cl.[7] ..... B41J 2/165

(52) U.S. Cl. ..... 347/22; 347/29; 347/30; 347/32; 347/33

(58) Field of Search ..... 347/22–35

(56) References Cited

U.S. PATENT DOCUMENTS 3,913,722 A 10/1975 Bowdle et al.
3,961,388 A 6/1976 Jaffa
4,375,189 A 3/1983 Berner et al.
4,378,622 A 4/1983 Pinkston et al.
4,589,505 A 5/1986 Takahashi
4,602,262 A 7/1986 Milligan et al.
4,703,346 A 10/1987 Bierhoff
4,901,641 A 2/1990 Steiner et al.
4,936,215 A 6/1990 Walker et al.
5,081,472 A 1/1992 Fisher
5,233,921 A 8/1993 John
5,372,644 A 12/1994 Kochsmeier
5,583,548 A 12/1996 Kearns
5,588,763 A 12/1996 Nubson et al.
5,949,453 A 9/1999 Harris et al.
6,109,746 A 8/2000 Jeanmaire et al.
6,217,145 B1 4/2001 Ito et al.
6,220,693 B1 4/2001 Bode et al.
6,663,215 B1 * 12/2003 Klausbruckner et al. ..... 347/22

FOREIGN PATENT DOCUMENTS

JP 59115863 A 7/1984

* cited by examiner

*Primary Examiner*—Shih-wen Hsieh

(57) ABSTRACT

An image forming device having a rotatable drum, at least one printhead mounted adjacent to the rotatable drum, and a printhead service station. The printhead and rotatable drum together define a print zone in which fluid travels from the printhead towards the rotatable drum, and the printhead service station is within the print zone.

17 Claims, 4 Drawing Sheets

PRINTHEAD SERVICE STATION

This is a Continuation of application Ser. No. 10/046,456 filed on Oct. 25, 2001, now U.S. Pat. No. 6,663,215.

FIELD OF THE INVENTIONS

The present inventions are related to image forming devices and, more specifically, to printhead service stations.

BACKGROUND OF THE INVENTIONS

There are a wide variety of drum-based image forming devices that include one or more printheads. In one type of drum-based image forming device, the print media is carried by a rotating cylindrical drum past a printhead assembly that translates back and forth over the drum. Ink is deposited by the printheads directly onto the print media to create the desired image. The printheads include a plurality of very small nozzles and are typically associated with ink ejecting cartridges (or "pens"). Ink drops are fired through the nozzles by an ink ejection mechanism, such as a piezoelectric or thermal ejection mechanism, to create the desired dot pattern (or "image").

The condition of the printheads is of paramount importance because of their direct effect on print quality. An improperly maintained printhead can become clogged and/or become the source of dot placement errors that reduce print quality. To that end, image forming devices that include printheads also typically include a printhead service station, which is located outside the print zone, to clean and protect the printheads. The printhead assembly moves from the rotating drum to the service station during non-printing periods and the shutdown process.

Spitting and wiping are two service station functions that may be performed during operation of the image forming device, albeit during non-printing periods, and also during start up and/or shutdown. Spitting clears clogs from the printhead by firing a number of drops of ink through each of the nozzles into a reservoir (or "spittoon") that is part of the service station. Spittoons often include light sensors for drop counting. With respect to wiping, service stations are typically provided with an elastomeric wiper blade that wipes the printhead surface to remove ink residue, paper dust and any other debris that may have collected on the printhead. The wiping action, which is usually achieved through relative motion of the printhead and the elastomeric wiper blade, benefits from the moistening effect of spitting. Capping is another function that may be associated with service stations. The service station capping system seals the printhead nozzles to protect them from contaminants and prevent drying. This function is typically only associated with the shutdown process. The printhead nozzles are unsealed at startup.

Efforts are also continuously being made to address the dot placement error problems that can arise even when the printheads are properly maintained. For example, the alignment of the printhead assembly and rotating drum can be a source of dot placement errors. Such errors may, however, be substantially reduced by selecting and maintaining the optimum angular orientation of the printhead assembly relative to the rotating drum. Depositing ink directly from the printheads onto the print media can be another source of dot placement errors. One proposed solution to this problem is an image forming device in which ink is deposited by the translating printheads onto a rotating drum (or "print cylinder"), and then transferred from the print cylinder to the print media. An example of this type of imaging forming device is disclosed in commonly assigned U.S. application Ser. No. 09/571,647, which was filed on May 15, 2000, and is entitled "Digital Press and Method of Using the Same."

Speed is another important printing consideration. Although service station functions such as spitting and wiping must be periodically performed, it is critical in many instances that downtime be minimized so that throughput can be maximized. The inventors herein have determined that moving the printhead assembly from the print zone to a service station and then back to the print zone is, however, a relatively slow process. It must be done carefully in order to insure that printhead errors are not introduced by variations in the orientation of the printhead assembly.

Accordingly, the inventors herein have determined that it would be desirable to increase the speed of service station functions such as, for example, spitting and wiping, without increasing the likelihood of dot placement errors in order to increase throughput while maintaining print quality.

BRIEF DESCRIPTION OF THE DRAWINGS

Detailed description of preferred embodiments of the inventions will be made with reference to the accompanying drawings. Certain aspects of the preferred embodiments have been eliminated from some or all of the views for clarity.

DETAILED DESCRIPTION

The following is a detailed description of the best presently known modes of carrying out the inventions. This description is not to be taken in a limiting sense, but is made merely for the purpose of illustrating the general principles of the inventions. Additionally, it is noted that detailed discussions of various operating components of image forming devices which are not pertinent to the present inventions, such as the ink ejecting pens and print control systems, have been omitted for the sake of simplicity.

Figure 1:
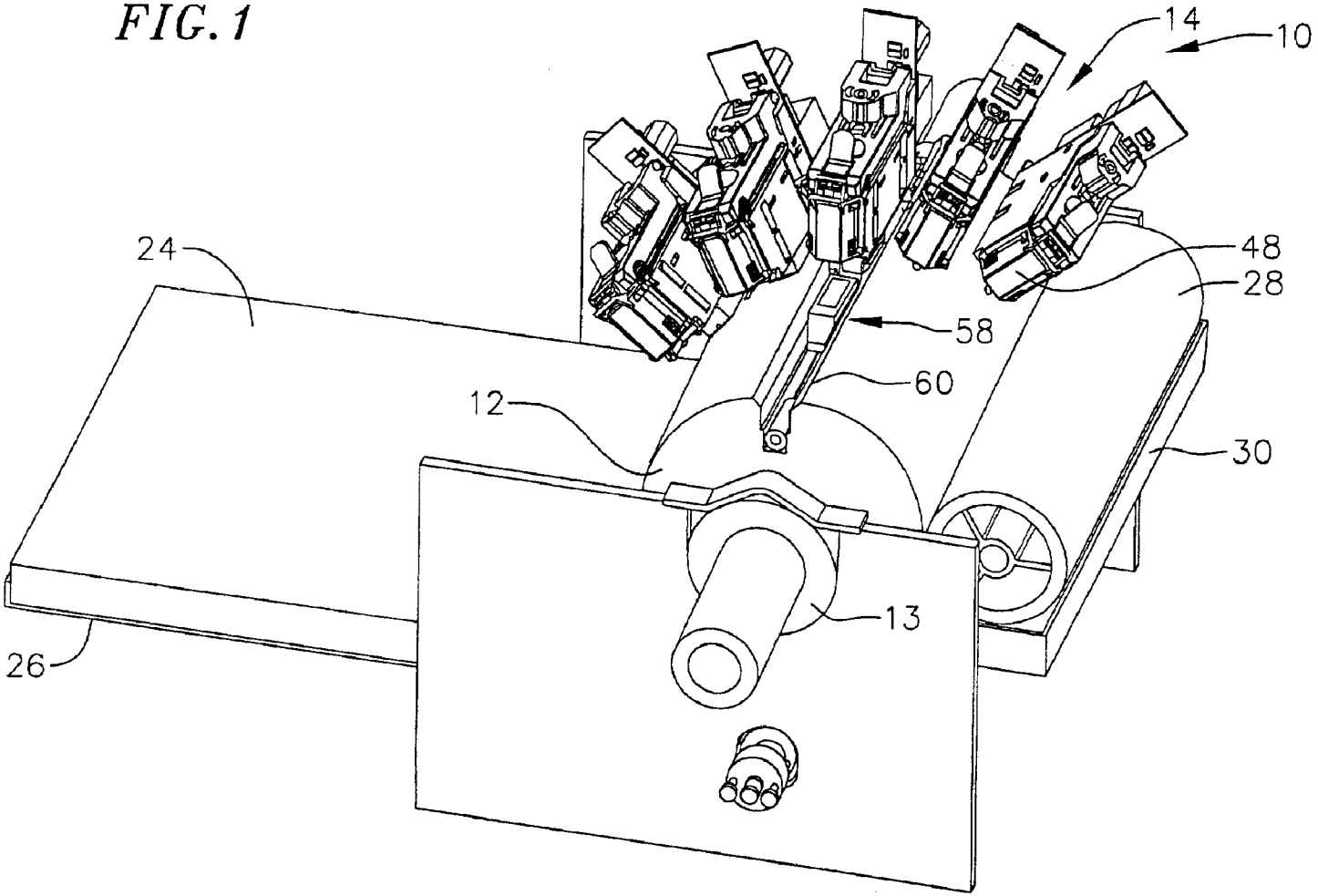
FIG. 1 is perspective view of an image forming device in accordance with a preferred embodiment of a present invention.
Figure 2:
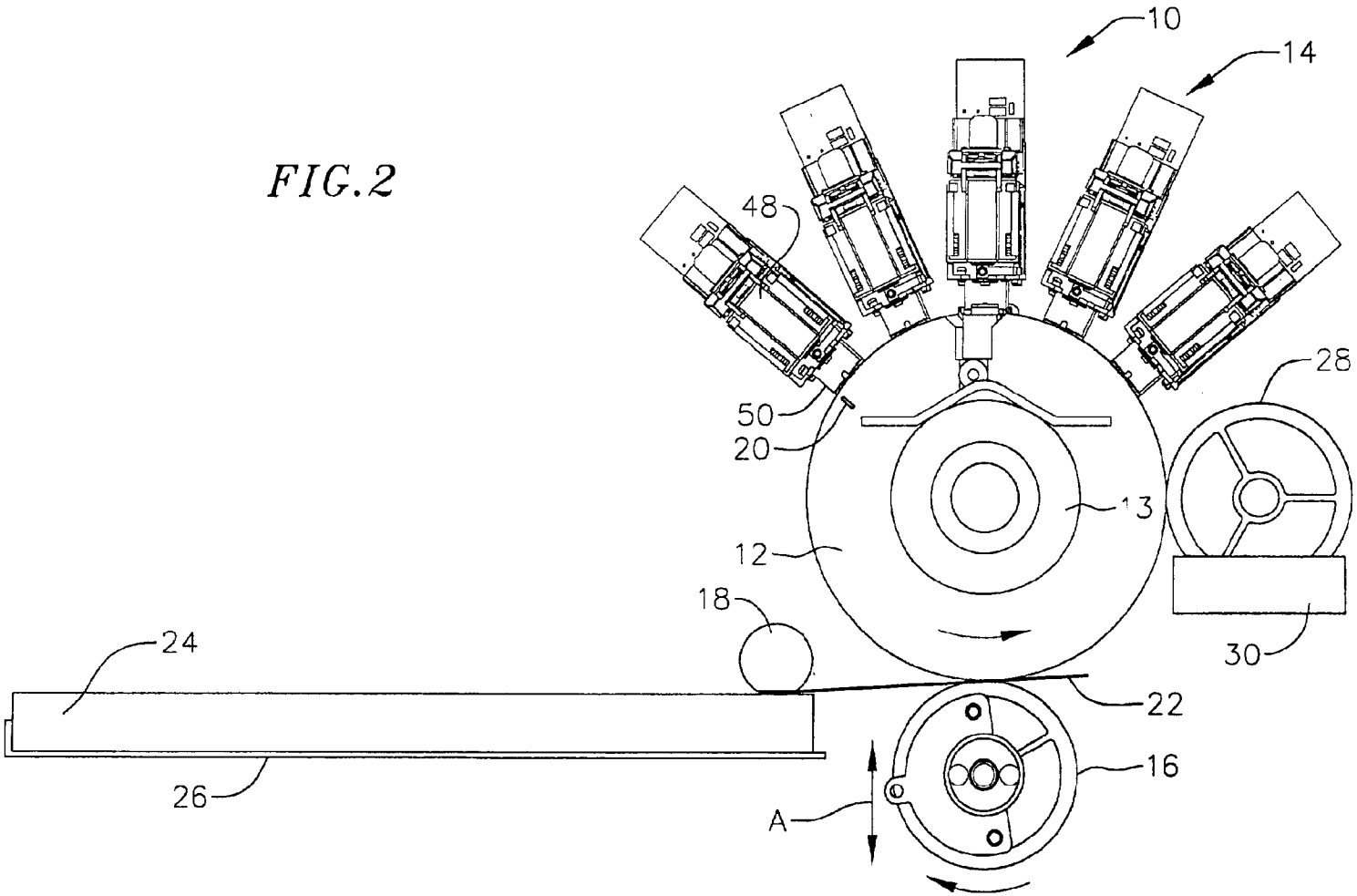
FIG. 2 is a side view of an image forming device in accordance with a preferred embodiment of a present invention.

As illustrated for example in FIGS. 1 and 2, an image forming device 10 in accordance with a preferred embodiment of a present invention includes a rotating print cylinder (or "drum") 12, which is mounted with bearings 13, and a printhead assembly 14, which is mounted in conventional fashion relative to the print cylinder such that it may be moved to a stationary service station (not shown) outside the print zone during shutdown for capping. A rotating impression roller 16 is positioned adjacent to the print cylinder 12 and is movable relative to the print cylinder (note arrow A). The exemplary printhead assembly 14 deposits ink onto the print cylinder 12 as the print cylinder rotates relative to the printhead assembly in accordance with a print control signal. The print control signal also prevents the ink from being ejected into a service station channel 60, which is discussed in greater detail below with reference to FIGS. 5 and 6, other than during printhead service operations.

The exemplary image forming device 10 is also provided with a media feed system that includes a pick roller 18 that is activated when an index mark 20 on the rotating print cylinder 12 passes a sensor (not shown). The pick roller 18 draws a piece of print media 22 such as, for example, a sheet of paper, a sheet of labels, or transparency film, from a stack 24 in a tray 26 and directs the print media to the print cylinder 12. Ink is then transferred from the print cylinder 12 to the print media 22 in a manner similar to offset printing. A cleaning roller 28, which is carried by a support 30, may be provided to remove any residual ink from the print cylinder 12.

The exemplary image forming device 10 also includes a movable service station, which is discussed in greater detail below with reference to FIGS. 5 and 6. The movable service station 52 in the exemplary embodiment is carried by the print cylinder 12. Nevertheless, other types of movable service stations, such as those advanced into the print zone from a position outside the print zone, may be employed. A movable service station eliminates the need to move the printhead (or printhead assembly) to the service station from its printing position adjacent to the drum during printing operations. Servicing the printhead in this manner reduces the amount of time required to perform periodic service station functions such as spitting and wiping and, accordingly, increases the overall productivity of the image forming device.

Figure 3:
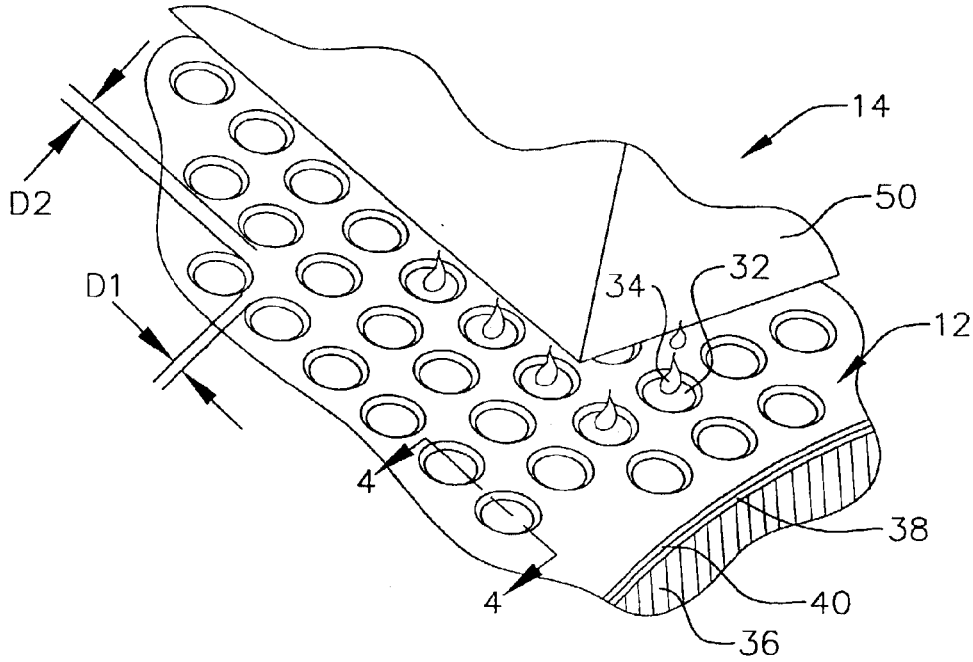
FIG. 3 is a perspective view of a portion of a print cylinder in accordance with a preferred embodiment of a present invention.

As illustrated for example in FIG. 3, the outer surface of the exemplary print cylinder 12 includes a plurality of embedded cells 32 that receive ink droplets 34 from the printhead assembly 14 in patterns that correspond to the desired image. The exemplary print cylinder 12 also includes a cylindrical core 36, which is preferably formed from steel or aluminum, and a copper sheath 38, which is preferably about 0.02 inch thick. Other core and sheath materials may, of course, be employed as desired or as applications require. The cells 32 are formed in the surface of the sheath 38 by electronic engraving or other suitable methods. The sheath 38, including the cells 32, is then plated with a layer of chromium 40 or other suitable material that is wear resistant and has non-wetting tendencies.

The size of the print cylinder 12 (i.e. the circumference and width), as well as the size and number of cells 32, may be varied in accordance with the intended application. The print cylinder 12 in the exemplary embodiment which, although not so limited, is well suited for many printing applications and has a diameter of 6 inches, a circumference of 18.85 inches and a width of 9 inches. The cells 32 are preferably identical in size and are arranged in rows and columns with separations D1 and D2. The separations D1 and D2 are between about 5 $\mu$m and 10 $\mu$m and, preferably, about 8 $\mu$m. Each cell 32 preferably corresponds to a single dot and the volume, which is about 30–40 pico-liters, will accommodate a single droplet 34. Cell density, like dot density, may be varied in accordance with the desired print quality. Although exemplary cell densities range from 75 dpi (dots/cells per inch) and below to 600 dpi and above, it has been found that excellent print quality may be achieved in the 75 dpi to 250 dpi range.

Figure 4:
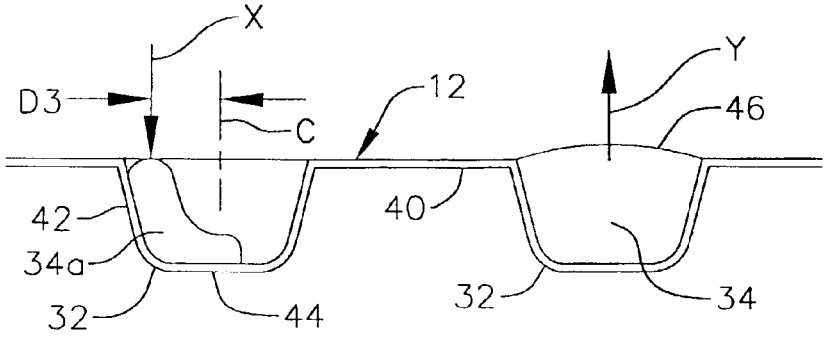
FIG. 4 is a section view taken along line 4—4 in FIG. 3.

Referring to FIGS. 3 and 4, and as noted above, the cells 32 receive ink droplets 34 from the orifices of the printhead assembly printheads 50 (discussed below) in a pattern that corresponds to the image being produced. The cells 32 include sidewalls 42 that are inclined (or "tapered") with respect to bottom walls 44 at an angle of between about 120 degrees and about 150 degrees, and preferably about 135 degrees. It is most desirable for an ink droplet 34 to be ejected into the center of the associated cell 32 so that the droplet fills the cell and forms a meniscus 46 across the top of the cell. Such precise positioning of the ink droplet 34 within the cell 32 is optimum for transfer (note arrow Y) and results in substantially no dot placement errors on the print media. More specifically, surface tension causes the ink droplet 34 to snap cleanly out of the cell 32 as it is transferred to the print media.

In some instances, an ink droplet 34*a* (FIG. 4) will be eccentrically ejected (note arrow X) by a distance D3 from the cell centerline C. This type of ejection error often results in dot placement errors in those image forming devices where the ink is ejected directly onto the print media. Here, however, the ink droplet 34*a* will settle into the center of the cell 32 during the time that it takes the cell to travel from the printhead assembly 14 to the print media 22, thereby eliminating the potential dot placement error.

It should also be noted here that the exemplary print cylinder 12 is not limited to circular cells in the illustrated pattern. For example, and as disclosed in aforementioned U.S. application Ser. No. 09/571,647, which is incorporated herein by reference, various diamond-shaped arranged in a variety of angular orientations with respect to the print cylinder axis may also be employed.

Turing to the printhead assembly, the exemplary printhead assembly 14 illustrated in FIGS. 1 and 2 includes five staggered pens 48 with printheads 50 that are about ⅝ of an inch wide. The resulting image will, therefore, be up to 2½ inches wide. A suitable printhead is the Hewlett-Packard C482x printhead, which should be mounted at 1.79 degree angle to print cylinder 12 for 20 inch per second printing. The printheads 50 are also about 1 mm from the print cylinder 12 in the exemplary embodiment. Of course, the number of pens as well as the size and type of the printheads may be varied as desired. Off-axis printhead arrangements, where the printheads carry a small amount of ink and are refilled by tubes that connect the pens to a remote ink reservoir, may also be employed.

The impression roller 16 in the exemplary embodiment includes a resilient surface that is more deformable than the surface of the print cylinder 12. A rubber impression roller surface having a durometer of between about 40 shore A and 90 shore A is preferred. The impression roller is moved against the print cylinder 12 when the piece of print media 22 is guided between the impression roller 16 and print cylinder. The impression roller 16 applies a force of approximately 30 lbs./in. of roller width to 60 lbs./in. of roller width, and preferably approximately 50 lbs./in. of roller width, against the print cylinder 12. Such force maintains intimate contact between the print cylinder 12 and print media 22 and, accordingly, facilitates precise ink transfer from the print cylinder to the print media without media cockling.

Figure 5:
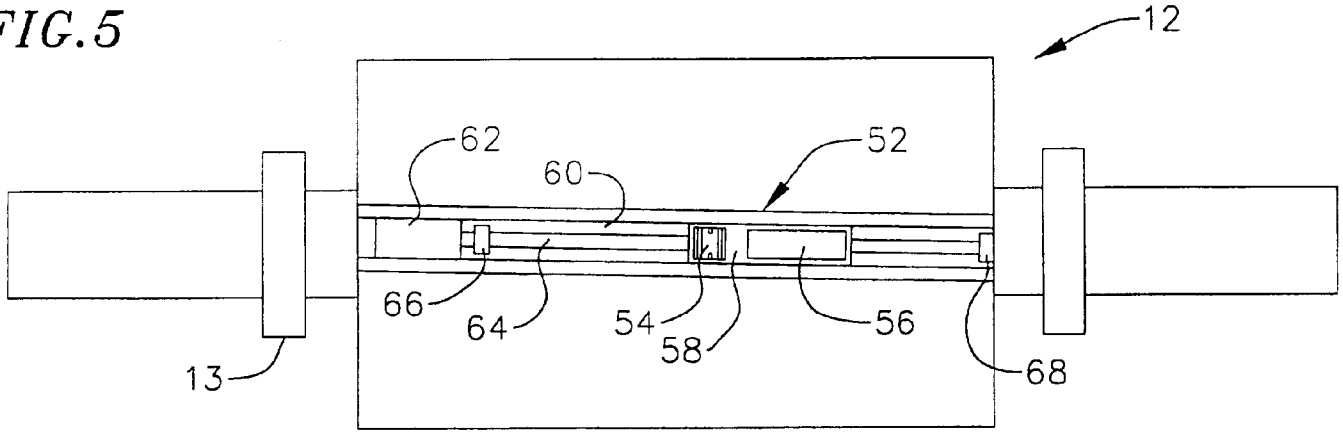
FIG. 5 is a plan view of the print cylinder illustrated in FIG. 3.
Figure 6:
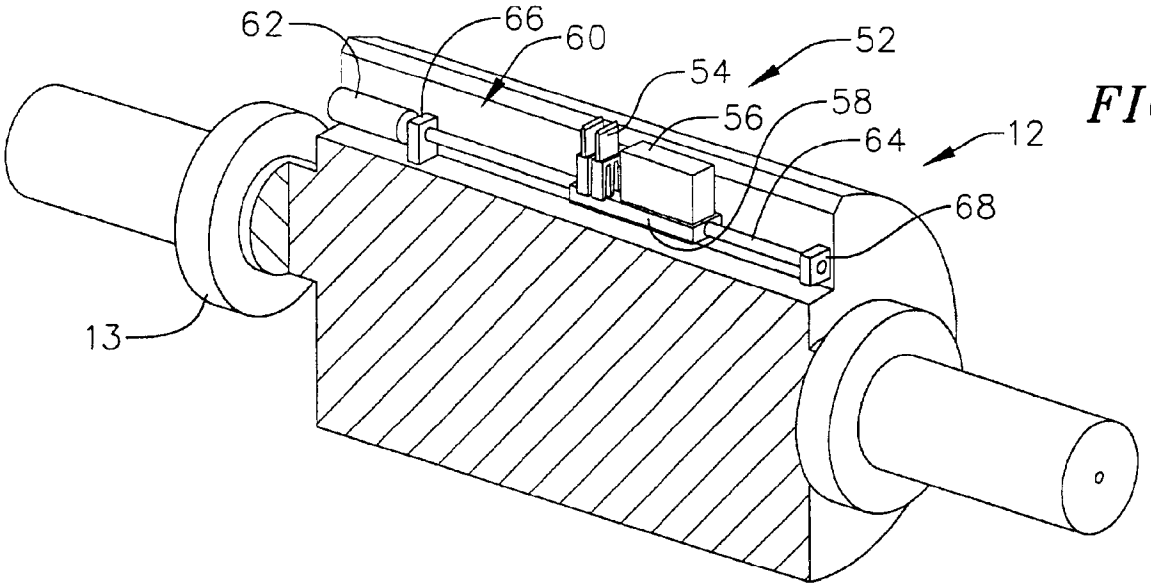
FIG. 6 is perspective, partial section view of the print cylinder illustrated in FIG. 3.

As illustrated in FIGS. 5 and 6, the exemplary movable service station 52 includes a pair of wipers 54 and a spittoon 56. The exemplary wipers 54 extend about 1.5 mm beyond the print cylinder 12, which is about 0.5 mm greater than the spacing between print cylinder and printheads 50, thereby creating mechanical interference between the wipers and printheads as the wipers are moved along the printheads. Thus, as discussed below, the wipers 54 in the exemplary embodiment will be moved to a position away from the printheads 50 during printing. Alternatively, the wipers 54 may be shorter and moved by a suitable device radially in to and out of engagement with the printheads 50, which would allow the wipers 54 to remain aligned with the printheads during printing. The exemplary spittoon 56 is an absorbent block, formed from open cell foam or other suitable material, that will absorb the ink droplets ejected during the spitting process and continue to hold the ink as the print cylinder 12 rotates. A drop counting sensor (not shown) may also be provided. The wipers 54 and spittoon 56 are mounted on a carrier 58 that is located within a channel 60 formed in the print cylinder 12. The channel 60 should be oriented at a slight angle (here, about 1.79 degrees) to the longitudinal axis of the print cylinder 12 in those instances where the printheads 50 are angled relative to the print cylinder.

The channel 60 in the exemplary embodiment extends from one longitudinal end of the print cylinder 12 to the other. The length of the channel 60 may, however, be modified as desired. For example, a channel in an image forming device that includes only a single printhead could be limited to an area directly under printhead that is only long enough to support the service functions.

A drive device, which in the exemplary embodiment is also at least partially located within the channel 60, drives the service station 52 back and forth within the channel. A motor 62 and worm gear 64 arrangement performs the drive function in the exemplary embodiment. Power is supplied to the motor 62 using a conventional inductive power transmission system (not shown). The worm gear 64, which is mounted on bearings 66 and 68, engages a follower (not shown) on the carrier 58. The print controller regulates power to the motor 62 in order to control the rotation of the worm gear 64 and, therefore, the position of the service station 52. For example, during printing, the service station 52 will be moved to a position close to the motor 62 and away from the printheads 50. A position sensing device, such as an encoder that senses rotation of the worm gear 64 or motor spindle, may be used to more precisely track and control the position of the service station 52.

The service station 52 may, of course, be driven in other ways. For example, a service station carrier could be provided with an on-board motor that drives the service station along a track. The drive device could also be mounted on the image forming device chassis instead of the print cylinder. For example, a motor could be mounted on the image forming device chassis and connected to the worm gear 64 during a service operation, and disconnected from the worm gear while the print cylinder is rotating, by a suitable gear and clutch arrangement.

The exemplary service station 52 may be employed in the manner described below during a printing operation being performed by the exemplary image forming device 10 as well as other image forming devices. The service station may, of course, also be employed during start up and shut down. Once it is determined that the printheads 50 are due for a spitting and wiping procedure, printing will cease and the cylinder will, if necessary, be rotated until the channel 60 is aligned with one of the printheads (referred to herein as rotational alignment). If the spittoon 56 is not already positioned under the printhead 50 at this point, the motor 62 and worm gear 64 arrangement will drive the service station 52 until the spittoon is aligned with the printhead (referred to herein as longitudinal alignment). Ink is then spit into the spittoon 56. Next, the service station 52 is moved along the channel 60 to longitudinally align the wipers 54 with the printhead 50. The service station (and wipers 54) will then be moved back and forth to clean the printhead 50.

After the wiping process has been completed, the print cylinder 12 may be rotated to bring the channel 60 into rotational alignment with the next printhead 50. The service station 52 will then be moved to longitudinally align the spittoon 56 with the next printhead 50 and the spitting and wiping will processes will be repeated. These steps will preferably continue until each of the printheads 50 has been serviced. Nevertheless, it should be noted that the exemplary printhead may be used to service fewer than all of the printheads 50 in those instances where it is determined that fewer than all of the printheads require service.

It should be noted that the present inventions are applicable to other types of image forming devices. For example, the present inventions are applicable to drum-based image forming devices in which the ink is deposited directly onto the print media, image forming devices which include a carriage that carries one or more printheads and translates over the printzone, and image forming devices which include a page-wide array printhead that extends the width of the printzone. It should also be noted that the present inventions are applicable to other types of pens. For example, the present inventions are applicable to typical replaceable inkjet cartridges and the printheads associated therewith.

Although the present inventions have been described in terms of the preferred embodiments above, numerous modifications and/or additions to the above-described preferred embodiments would be readily apparent to one skilled in the art. By way of example, and not limitation, a capping device may be provided on the service station. It is intended that the scope of the present inventions extend to all such modifications and/or additions.

What is claimed is:

1. A drum capable of being used in an image forming device including a printhead, comprising:

a substantially cylindrical member defining a channel; and a printhead service station that is at least partially within the channel and is movable relative to the channel.

2. A drum as claimed in claim 1, wherein the substantially cylindrical member defines first and second longitudinal ends and the channel extends substantially from the first longitudinal end to the second longitudinal end.

3. A drum as claimed in claim 1, wherein the substantially cylindrical member comprises a print cylinder.

4. A drum capable of being used in an image forming device including a printhead, comprising:

a substantially cylindrical member defining a channel; and a printhead service station that includes a spittoon and a wiper and is at least partially within the channel.

5. An image forming device, comprising:

a rotatable drum;

at least one printhead mounted adjacent to the rotatable drum, the printhead and rotatable drum together defining a print zone in which fluid travels from the printhead towards the rotatable drum; and a printhead service station within the print zone such that the service station can service the printhead without substantially moving the printhead relative to the print zone.

6. The image forming device of claim 5 wherein the printhead service station is movable between a first position outside the print zone and a second position within the print zone.

7. An image forming device as claimed in claim 5, wherein the at least one printhead is a portion of a cartridge.

8. An image forming device as claimed in claim 5, wherein the at least one printhead is mounted in a substantially fixed position relative to the rotatable drum during operation of the printhead service station.

9. An image forming device as claimed in claim 5, wherein the at least one printhead comprises a plurality of printheads and the printhead service station is movable between a plurality of cleaning positions respectively aligned with the plurality of printheads.

10. An image forming device as claimed in claim 9, wherein the plurality of service station positions are rotatably and longitudinally offset from one another.

11. An image forming device as claimed in claim 5, wherein the rotatable drum includes a drive mechanism that moves the printhead service station.

12. An image forming device, comprising:

a rotatable drum;

at least one printhead mounted adjacent to the rotatable drum, the printhead and rotatable drum together defining a print zone in which fluid travels from the printhead towards the rotatable drum; and a printhead service station that includes a spittoon and a wiper within the print zone.

13. An image forming device as claimed in claim 12, wherein the rotatable drum comprises a print cylinder.

14. A replaceable printer component comprising:

a substantially cylindrical member defining a channel; and a printhead service station that is at least partially within the channel and is movable relative to the channel.

15. A method of servicing a printhead mounted adjacent to a rotatable drum such that a print zone in which fluid travels from the printhead towards the rotatable drum is defined between the printhead and the rotatable drum, the method comprising:

moving a printhead service station into the print zone without substantially moving the printed; and servicing the printhead with the printhead service station.

16. A method as claimed in claim 15, wherein servicing the printhead includes-wiping the printhead.

17. A method as claimed in claim 15, wherein the printhead service station includes a spittoon and servicing the printhead includes spitting fluid into the spittoon.

* * * * *